US006397501B1

(12) United States Patent
Lembcke

(10) Patent No.: US 6,397,501 B1
(45) Date of Patent: Jun. 4, 2002

(54) WIDE MULTIPLE-CHAIN TRENCHING MACHINE

(76) Inventor: Joseph P. Lembcke, c/o Miah, Inc. 161 High St. SE. Suite 221, Salem, OR (US) 97301

( * ) Notice: Subject to any disclaimer, the term of this patent is extended or adjusted under 35 U.S.C. 154(b) by 0 days.

(21) Appl. No.: 09/502,402

(22) Filed: Feb. 10, 2000

Related U.S. Application Data

(60) Provisional application No. 60/119,699, filed on Feb. 11, 1999.

(51) Int. Cl.[7] ..... E02F 5/02

(52) U.S. Cl. ..... 37/465; 37/352; 37/364

(58) Field of Search ..... 37/189, 462, 464, 37/465, 347, 352, 364; 299/75, 34.01, 34.02, 82.1; 405/180, 174

(56) References Cited

U.S. PATENT DOCUMENTS

| | | | | |
|---|---|---|---|---|
| 2,237,773 A | * | 4/1941 | Voorhis et al. | 37/364 |
| 2,650,812 A | | 9/1953 | Joy | |
| 2,926,896 A | | 3/1960 | Krekeler | |
| 2,939,692 A | | 6/1960 | Russell et al. | |
| 3,050,295 A | | 8/1962 | Osgood | |
| 3,954,301 A | | 5/1976 | Stepp | |
| 4,194,311 A | * | 3/1980 | Thames | 37/192 A |
| 4,432,584 A | | 2/1984 | Vartanov et al. | |
| 4,908,967 A | | 3/1990 | Leece | |
| 5,228,220 A | * | 7/1993 | Bryan, Jr. | 37/364 |
| 5,471,771 A | | 12/1995 | Gilbert | |
| 5,497,567 A | | 3/1996 | Gilbert | |
| 5,601,383 A | * | 2/1997 | Zanin | 405/154 |

* cited by examiner

*Primary Examiner*—Thomas B. Will
*Assistant Examiner*—Kristine Markovich
(74) *Attorney, Agent, or Firm*—David S. Alayi

(57) ABSTRACT

A multiple-chain trenching machine comprises a prime mover with a trenching head assembly operably connected thereto. The trenching head may be raised, lowered, and/or pivoted relative to the prime mover, and comprises: a) a frame operably connected to the prime mover at a proximal end; b) one or more pairs of proximal and distal primary sprockets mounted on the frame; c) a primary endless-chain digging assembly engaged with and circulating around each pair of primary sprockets; d) one or more pairs of proximal and distal secondary sprockets mounted on the frame; e) a secondary endless-chain digging assembly engaged with and circulating around each pair of secondary sprockets. The primary chains are substantially wider than the secondary chains, and the diameters and positions of the sprockets may be such that each of the secondary chains cuts more deeply into the ground formation than the primary chains, thereby producing a narrow relief slot corresponding to each secondary chain. The primary chains are driven in a forward chain direction, so that disintegrated material is removed from the trench by the motion of the primary chains. The secondary chains may be driven in a forward or a reverse chain direction at about one to eight times the linear speed of the primary chains. If operated in the reverse chain direction, the disintegrated material produced by the secondary chains may be deposited within the trench by the motion of the secondary chains. The material thus deposited may serve as a support bed for whatever structure is to be subsequently placed within the trench.

13 Claims, 5 Drawing Sheets

WIDE MULTIPLE-CHAIN TRENCHING MACHINE

RELATED APPLICATIONS

This application claims benefit of prior-filed co-pending provisional application Ser. No. 60/119,699, filed Feb. 11, 1999, said application being hereby incorporated by reference as if fully set forth herein.

FIELD OF THE INVENTION

The field of the present invention relates to chain-type trenching machines. In particular, apparatus and methods are described herein for digging wide trenches with a multiple-chain trenching machine.

BACKGROUND

A wide variety of construction situations require the digging of trenches in rock or other hard earth formations. Chain-type trenching machines are commonly used for this purpose, and several such machines, as well as other types of digging machines, are described in U.S. Pat. Nos.: 5,497,567; 5,471,771; 4,908,967; 4,432,584; 3,954,301; 3,050,295; 2,939,692; 2,926,896; and 2,650,812. Each of these nine patents is hereby incorporated by reference as if filly set forth herein.

It has been observed that while these trenching machines work fairly well for digging relatively narrow trenches (less than about 24 inches wide, for instance), such machines become increasingly inefficient for digging relatively wide trenches (greater than about 36 to 48 inches, for example). Such wide trenches are required to accommodate large buried structures, such as large diameter oil and gas pipelines, for example. In addition, placement of structures within the trench frequently requires that relatively finely divided material (such as sand, gravel, crushed rock, etc.) must be placed in the trench to provide a support bed (also referred to as padding or bedding material) for the structure. This requires an extra step after digging the trench and before placing the structure within the trench, and requires the transportation of the material to and placement within the trench.

It is therefore desirable to provide apparatus and methods for digging wide trenches in rock or other hard earth formations which are more efficient than those currently available. It is also desirable to provide apparatus and methods for digging such trenches in which relatively finely divided material is simultaneously produced and deposited within the trench to provide a support bed for a structure placed within the trench.

SUMMARY

Certain aspects of the present invention may overcome one or more aforementioned drawbacks of the previous art and/or advance the state-of-the-art of trenching apparatus and methods, and in addition may meet one or more of the following objects:

- To provide apparatus and methods for digging wide trenches in rock or other hard earth formations;
- To provide apparatus and methods for digging wide trenches in rock or other hard earth formations using multiple endless-chain digging assemblies;
- To provide apparatus and methods for digging wide trenches in rock or other hard earth formations using multiple endless-chain digging assemblies, wherein two or more relatively narrow secondary endless-chain digging assemblies are operated at a relatively fast speed for cutting relief slots;
- To provide apparatus and methods for digging wide trenches in rock or other hard earth formations using multiple endless-chain digging assemblies, wherein a relatively wide primary endless-chain digging assembly is operated at a relatively slow speed in a forward direction between the secondary digging assemblies for disintegrating and removing material left between the relief slots;
- To provide apparatus and methods for digging wide trenches in rock or other hard earth formations using multiple endless-chain digging assemblies, wherein secondary digging assemblies are operated in a reverse direction for depositing disintegrated material within the trench, the deposited material serving as a support bed for structures subsequently placed within the trench; and
- To provide apparatus and methods for digging wide trenches in rock or other hard earth formations using multiple endless-chain digging assemblies, wherein two or more relatively narrow secondary endless-chain digging assemblies are operated at a relatively fast speed in a reverse direction for cutting relief slots and for depositing disintegrated material within the trench, the deposited material serving as a support bed for structures subsequently placed within the trench.

One or more of the foregoing objects may be achieved in the present invention by a multiple-chain trenching machine comprising a prime mover with a trenching head assembly operably connected thereto. The trenching head may be raised, lowered, and/or pivoted relative to the prime mover, and comprises: a) a frame having a proximal end operably connected to the prime mover, and a distal end; b) one or more pairs of primary sprockets, each pair comprising a proximal primary sprocket rotatably mounted on the frame and a distal primary sprocket rotatably mounted on the frame at the distal end thereof; c) a primary endless-chain digging assembly (hereinafter, "primary chain") engaged with and circulating around each pair of primary sprockets and comprising a plurality of pivotably connected links and a plurality of cutting tools substantially rigidly mounted thereon for disintegrating the earth formation; d) one or more pairs of secondary sprockets, each pair comprising a proximal secondary sprocket rotatably mounted on the frame and a distal secondary sprocket rotatably mounted on the frame at the distal end thereof; e) a secondary endless-chain digging assembly (hereinafter, "secondary chain") engaged with and circulating around each pair of secondary sprockets and comprising a plurality of pivotably connected links and a plurality of cutting tools substantially rigidly mounted thereon for disintegrating the earth formation.

The primary chains are substantially wider than the secondary chains, and the diameters and positions of the sprockets may be such that each of the secondary chains cuts more deeply into the ground formation than the primary chains, thereby producing a narrow relief slot corresponding to each secondary chain. The primary chains are driven in a forward chain direction, so that disintegrated material is removed from the trench by the motion of the primary chains. The secondary chains may be driven in a forward or a reverse chain direction at about one to eight times the linear speed of the primary chains. If operated in the reverse chain direction, the disintegrated material produced by the secondary chains may be deposited within the trench by the motion of the secondary chains. The material thus deposited may serve as a support bed for whatever structure is to be subsequently placed within the trench.

One or more of the foregoing objects may be achieved in the present invention by a method for digging wide trenches in rock or other hard earth formations using multiple endless-chain digging assemblies, comprising the steps of: a) positioning a trenching head assembly (as described in the previous paragraph) in the ground formation at the desired depth; b) driving the primary chains in a forward direction; c) driving the secondary chains at about one to eight times the linear speed of the primary chains; d) moving the trenching head assembly in a forward trench-digging direction; e) conveying, by the forward motion of the primary chains, disintegrated material out of the trench; and f) if the secondary chains are driven in the reverse direction, depositing, by the reverse motion of the secondary chains, disintegrated material within the trench to serve as a support bed for a structure subsequently placed therein.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

Figure 1:
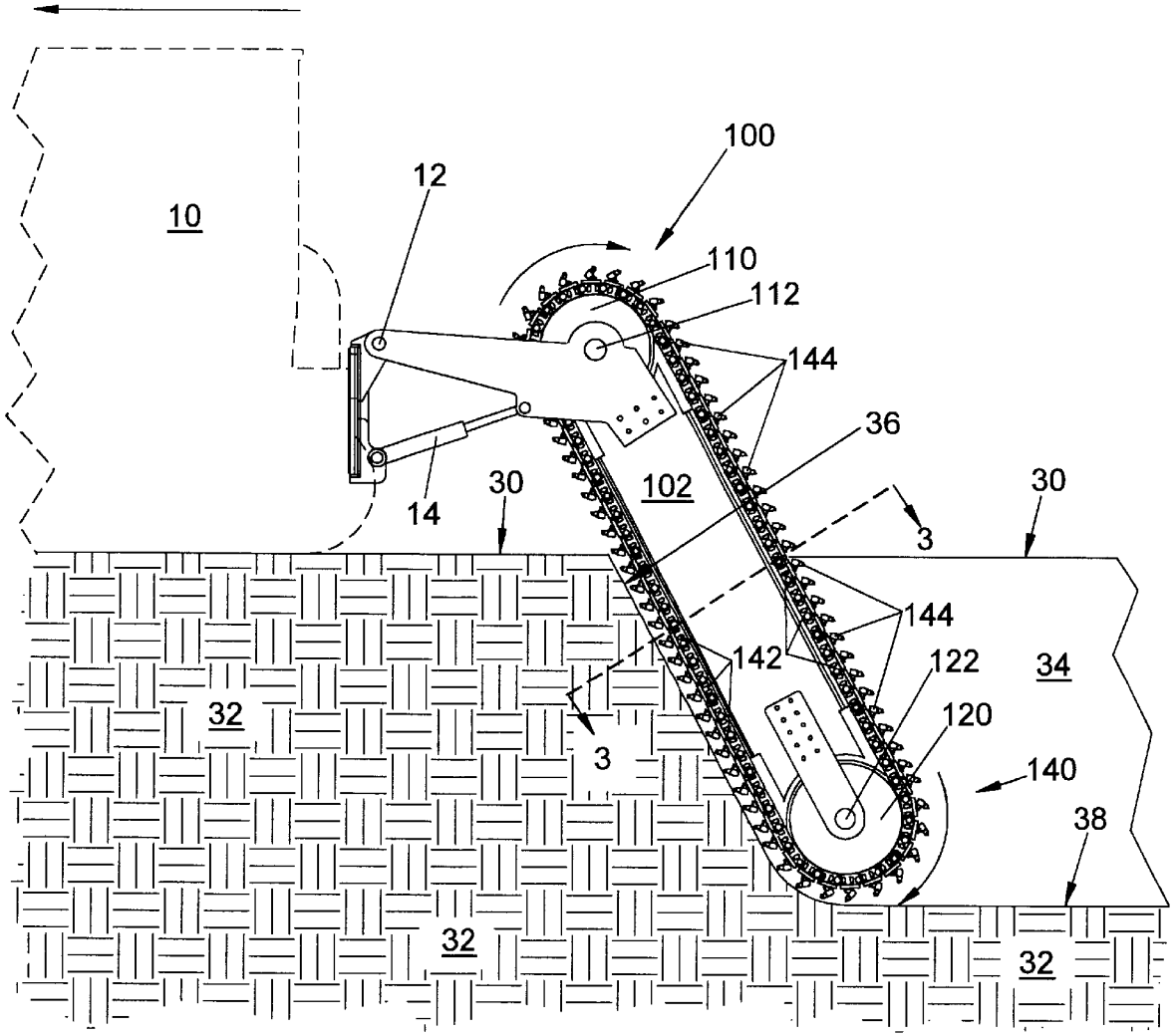
FIG. 1 shows a side view of a trenching machine according to the present invention with a chain being driven in the forward direction.

For purposes of the present written description and/or claims, the word "chain" shall, unless otherwise specified, denote an endless-chain digging assembly comprising a series of pivotably connected links, each of the links engaging corresponding sprockets and/or carrying earth-cutting tools. Each chain typically forms a closed loop encompassing corresponding sprockets, the chain being engaged therewith. Driving of one of the sprockets (a "drive sprocket") typically causes circulating motion of the chain about the corresponding sprockets. Many suitable types and configurations of chain links and corresponding sprockets may be employed without departing from inventive concepts disclosed and/or claimed herein. In particular, a roller may be used in place of any non-driven sprocket (an "idler sprocket") while remaining within the scope of inventive concepts disclosed and/or claimed herein, and "sprocket" should be construed in a non-driven position to encompass a roller or other similar idler structure about which a chain may be engaged. Likewise a wide variety of earth cutting tools, or bits, and various combinations and configurations thereof, may be employed without departing from inventive concepts disclosed and/or claimed herein. Some examples of such chain link types and/or configurations, and some examples of such earth-cutting tools and combinations/configurations thereof, are disclosed in the patents incorporated by reference hereinabove.

For purposes of the present written description and/or claims, the phrase "forward trench-digging direction" or "forward direction" when referring to movement of the trenching machine shall denote the direction in which the trench is being dug. The phrase "forward chain direction" or "forward direction" when referring to an endless-chain digging assembly (i.e., chain) shall denoted motion of the chain about the corresponding sprockets so that the portion of the chain in contact with the ground formation being disintegrated moves in the direction that conveys disintegrated material out of the trench. The phrase "reverse chain direction" or "reverse direction" when referring to a chain shall denoted motion of the chain about the corresponding sprockets so that the portion of the chain in contact with the ground formation being disintegrated moves in the direction that deposits disintegrated material within the trench. For example, in the side view of FIG. 1, the forward trench-digging motion of the trenching machine is to the left, while the portion of the trench already dug is to the right. Motion of a chain in a forward chain direction appears clockwise in FIG. 1, with the left portion of the chain (in contact with the ground formation being disintegrated, i.e., the leading edge of the trench) moving upward and conveying disintegrated material out of the trench. Conversely, motion of a chain in a reverse chain direction appears counter-clockwise in FIG. 2, with the left portion of the chain (in contact with the ground formation being disintegrated) moving downward and depositing disintegrated material within the trench.

Figure 2:
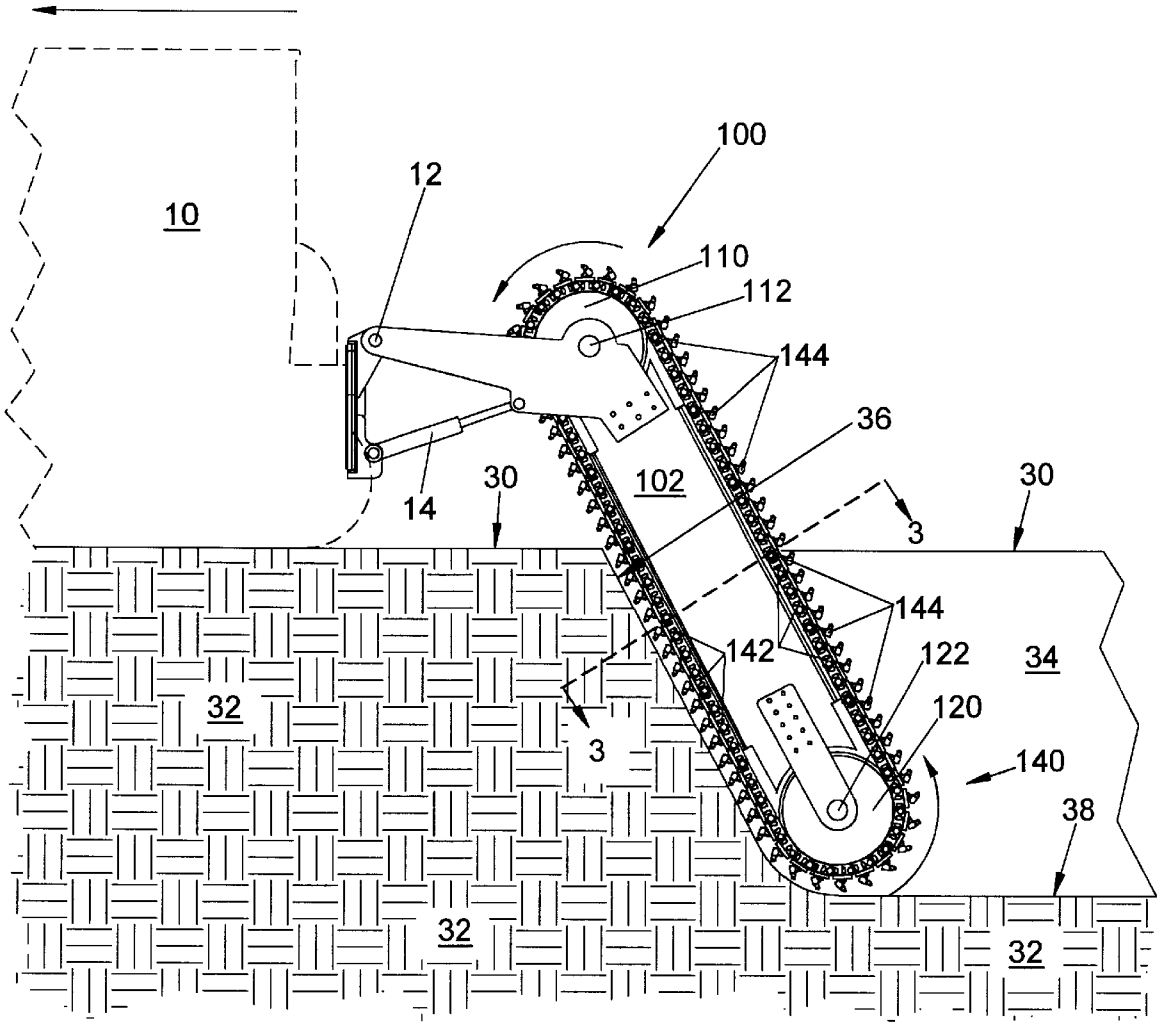
FIG. 2 shows a side view of a trenching machine according to the present invention with a chain being driven in the reverse direction.

FIGS. 1 and 2 show a side view of a trenching machine according to the present invention. Prime mover 10 is shown resting on ground surface 30 with trenching head 100 operably connected thereto. The prime mover may employ crawler treads, wheels, and/or any other suitable means for moving the trenching head along the desired trench path without departing from inventive concepts disclosed and/or claimed herein. Many suitable mechanisms are well known in the art, and some of these are disclosed in the patents incorporated by reference hereinabove. Trenching head 100 is operably connected so that the trenching head may be positioned (relative to the prime mover) to dig a trench of the desired depth below ground surface 30, or alternatively positioned for transportation of the trenching machine. Motions required of the trenching head relative to the prime mover may include, but are not limited to, pivoting in a vertical plane at the proximal end of the trenching head and/or vertical translation of the trenching head. Actuators of any suitable type may be employed to accomplish operable positioning of the trenching head relative to the prime mover without departing from inventive concepts disclosed and/or claimed herein. Many examples of suitable operable positioning and means of actuation thereof are known in the art, and some of these are disclosed in the patents incorporated by reference hereinabove.

As illustrated in FIGS. 1 and 2, trenching head 100 may be pivoted relative to the prime mover 10 about pivot point 12 by hydraulic actuator 14. Trenching head 100 may be pivoted upward to a substantially horizontal position (not shown) for transportation, and may be pivoted downward so that it cuts into a ground surface 30 until reaching a desired trench depth below surface 30. Once a desired trench depth has been reached, prime mover 10 may be employed to move the trenching head in a forward direction to elongate the trench 34 within ground formation 32, by disintegrating and removing material at leading edge 36 of trench 34. Trenching head 100 comprises a frame 102 having multiple pairs of proximal and distal sprockets rotatably mounted thereon. The distal sprockets may be mounted at the distal end of frame 102, while the proximal sprockets may be mounted at one or more positions on the frame 102, including at the proximal end of frame 102. One such pair of proximal sprocket 110 and corresponding distal sprocket 120, mounted on shafts 112 and 122, respectively, is shown in FIGS. 1 and 2. Any other suitable mounting structure may be employed for rotatably mounting sprockets on frame 102 while remaining within the scope of inventive concepts disclosed and/or claimed herein. Chain 140, comprising links 142 with cutting tools 144 mounted thereon, is shown engaged with sprockets 110 and 120 and being driven in a forward direction in FIG. 1, indicated by the arrows (clockwise in FIG. 1). Forward motion of chain 140 results in disintegration of ground formation 32 at leading edge 36 of trench 34. Cutting tools 144 may be suitably adapted (by shape, position, orientation, and so forth) to cut the ground formation and convey disintegrated material out of the trench when chain 140 is driven in the forward chain direction. The disintegrated material is conveyed upward by the upward motion of the portion of chain 140 in contact with trench leading edge 36. The upwardly conveyed material leaves the trench in front of trenching head and may be collected by any suitable means without departing from inventive concepts disclosed and/or claimed herein. Chain 140 is shown being driven in the reverse chain direction in FIG. 2, indicated by the arrows (counter-clockwise in FIG. 2). Reverse motion of chain 140 results in disintegration of ground formation 32 at leading edge 36 of trench 34. The disintegrated material is conveyed downward by the downward motion of the portion of chain 140 in contact with trench leading edge 36. Cutting tools 144 may be suitably adapted (by shape, position, orientation, and so forth) to cut the ground formation and deposit disintegrated material within the trench when chain 140 is driven in the reverse chain direction. The downwardly conveyed material is deposited on bottom 38 of trench 34. Disintegrated material thus deposited my serve as a support bed for any structures or objects subsequently placed within the trench, such as pipelines or conduits. Earth-digging tools 144 may be positioned, aligned, and/or otherwise configured on chain 140 in any of a variety of appropriate manners depending on the direction of travel of chain 140, i.e. for upwardly conveying disintegrated material when mounted on a forward-driven chain, or for downwardly conveying disintegrated material when mounted on a reverse-driven chain.

Figure 3:
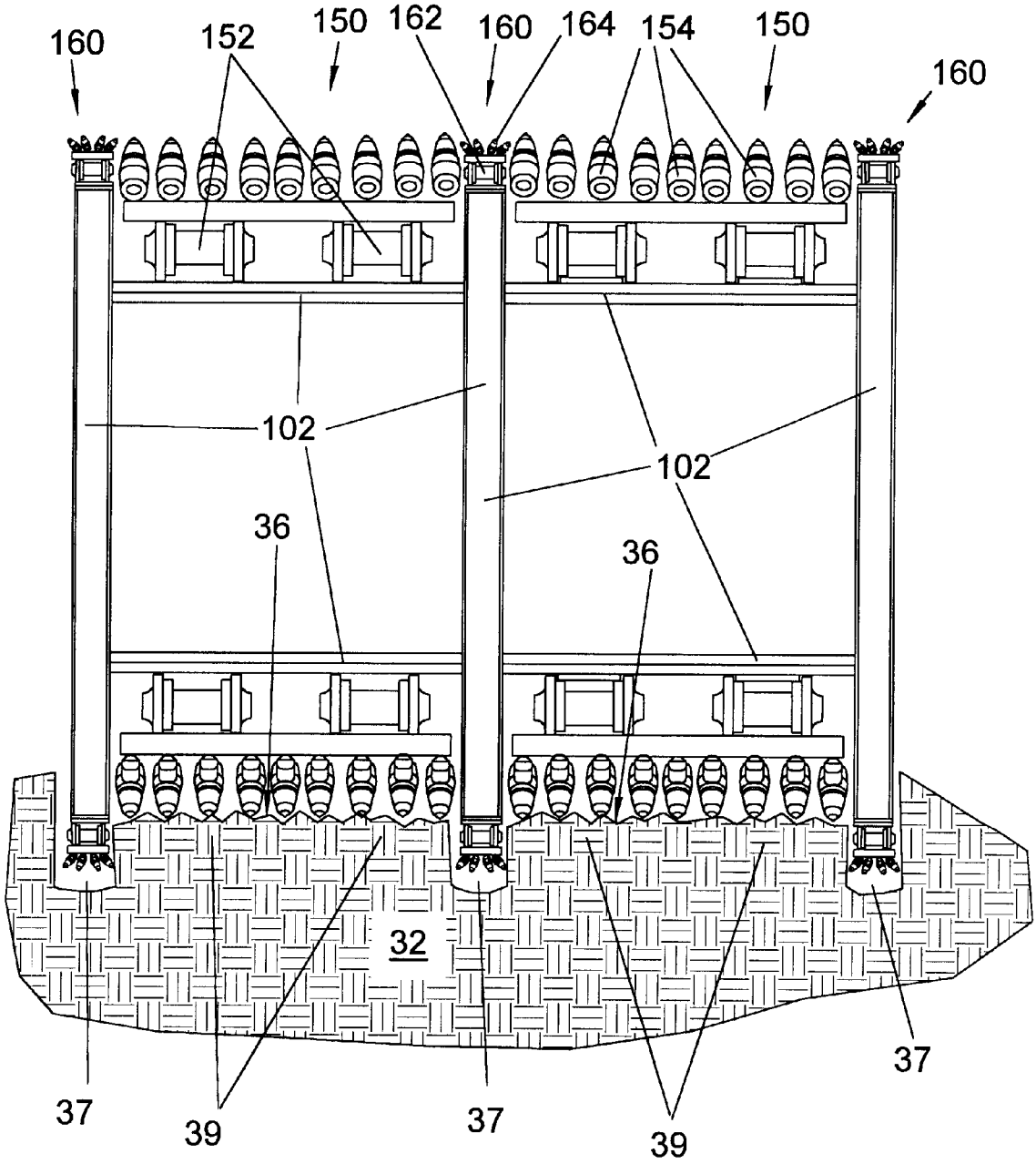
FIG. 3 shows a cross-section of a trenching head according to the present invention.

FIG. 3 shows a cross section of trenching head 100. One or more primary chains 150 are shown, as well as multiple secondary chains 160, each moving about frame 102 engaged with corresponding sprockets (not shown). Each of primary chains 150, if viewed from the side, appears as generally depicted in FIG. 1, comprising links 152 and earth-cutting tools 154 and moving about its corresponding sprockets in a forward chain direction. Primary chains 150 therefore disintegrate the ground formation 32 at trench leading edge 36 and convey the disintegrated material upward and out of the trench. Each of secondary chains 160, comprising links 162 and earth-cutting tools 164, may appear as generally depicted in FIG. 2, moving about its corresponding sprockets in a reverse chain direction, disintegrating the ground formation 32 at trench leading edge 36, and conveying the disintegrated material downward and depositing the material on the bottom of the trench. Alternatively, each of secondary chains 160 may appear as generally depicted in FIG. 1, moving in a forward chain direction and operating similarly to primary chains 150. Secondary chains may be provided at the sides of trenching head, as well as between primary chains 150.

In a preferred embodiment of the present invention, primary chains 150 may be between about 12 inches and about 24 inches wide, preferably about 18 inches wide and move at a linear velocity between about 200 feet/minute and about 400 feet/minute, preferably about 300 feet/minute. Secondary chains 160 may be between about 1 inch wide and about 6 inches wide, preferably about 3 inches wide, and move at a linear velocity of between about 200 feet/minute and about 2500 feet/minute, preferably about 1200 feet/minute. Note that the chain widths refer to the size of the resulting cut in the ground formation, which, depending on the positioning/alignment of the earth-cutting tools, may be wider than the actual width of the links of the chain. Earth-cutting tools 164 on secondary chains 160 may be smaller than earth-cutting tools on primary chains 150, although any combination of relative tool sizes may be employed without departing from inventive concepts disclosed and/or claimed herein.

The combination of relatively wider chain, relatively slower velocity, and/or relatively larger earth-cutting tools may render primary chains 150 relatively more suitable for disintegrating and conveying relatively large amounts of relatively coarsely divided material out of the trench. The combination of relatively narrower chain, relatively faster velocity, and/or relatively smaller earth-cutting tools may render secondary chains 160 relatively more suitable for disintegrating and depositing relatively small amounts of relatively finely divided material on the bottom of the trench. The coarsely divided material may be more easily removed from the trenching site and disposed of, while the more finely divided material may be more suitable as a support bed material. In addition to producing support bed material, driving primary chains and secondary chains in opposite directions may also serve to reduce vibrations during operation of the trenching machine, since forces arising from engagement of the primary and secondary chains with the ground formation will tend to partially counter-balance one another.

Figure 4:
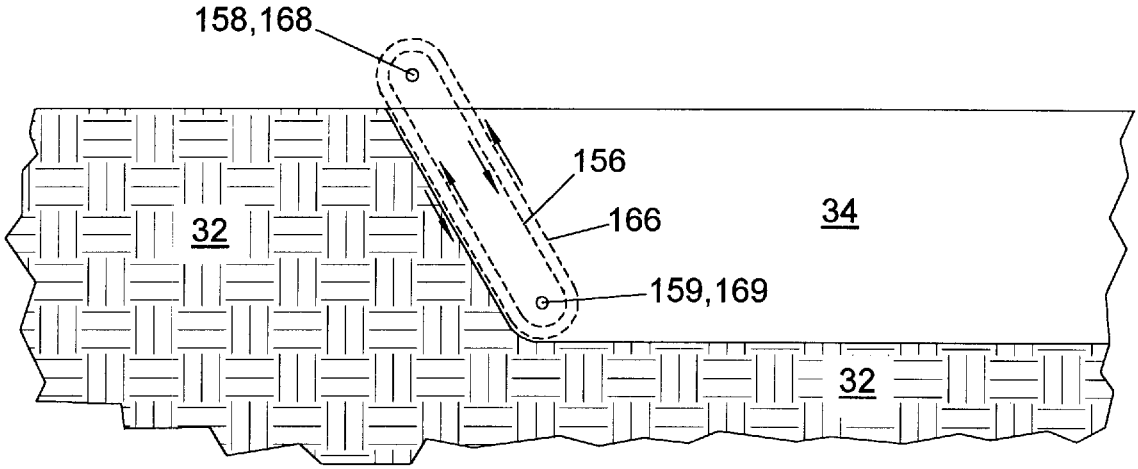
FIG. 4 shows a schematic side view of primary and secondary chain paths for a trenching head according to the present invention.
Figure 5:
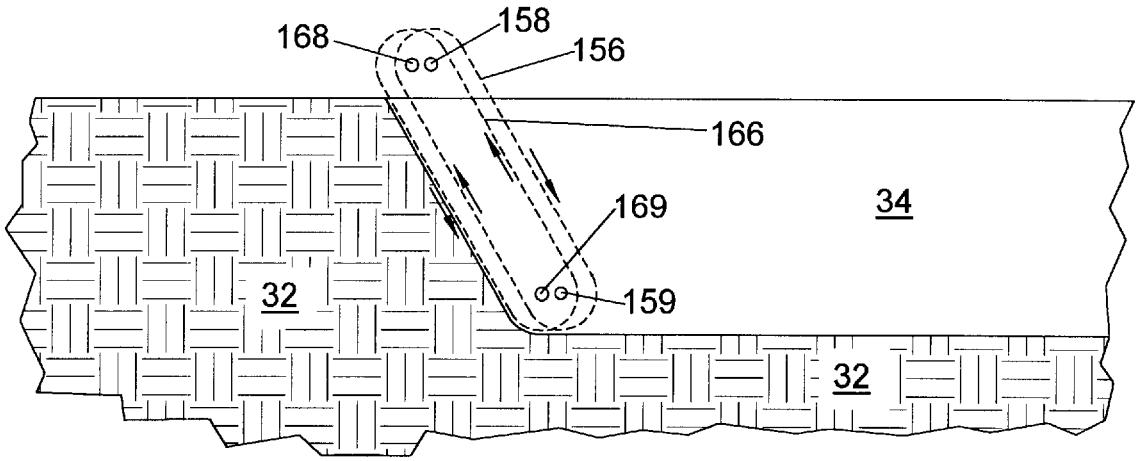
FIG. 5 shows a schematic side view of primary and secondary chain paths for a trenching head according to the present invention.
Figure 6:
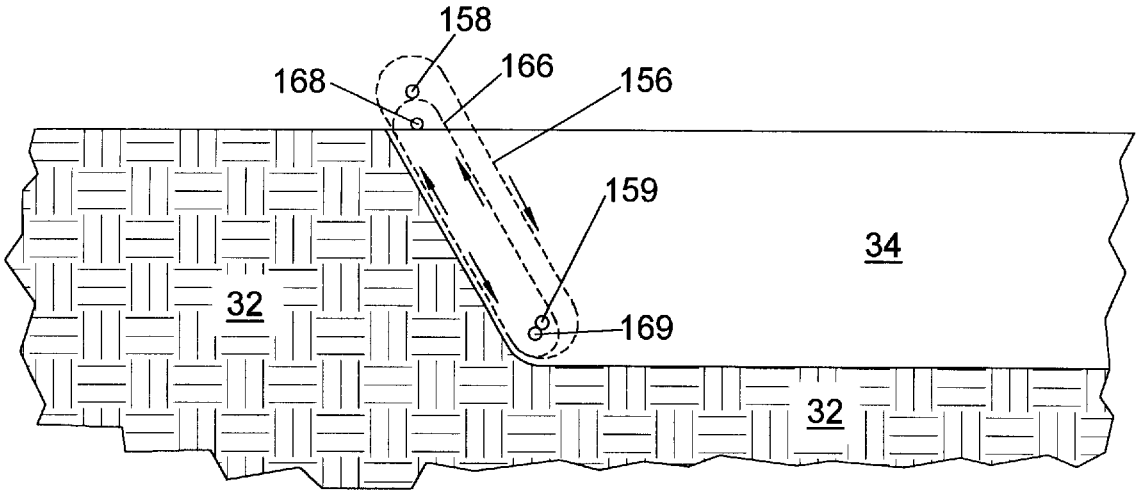
FIG. 6 shows a schematic side view of primary and secondary chain paths for a trenching head according to the present invention.

In a preferred embodiment of the present invention, sprockets for secondary chains 160 may be sized and positioned so that path 166 followed by secondary chains 160 may be larger than path 156 followed by primary chains 150, as shown in FIG. 3 and schematically in FIG. 4. This results in a narrow relief slot 37 being cut by each secondary chain 160. The projecting cores 39 of ground formation 32 thus produced between pairs of relief slots 37 may be more readily removed by primary chains 150, since presence of the relief slots 37 may decrease lateral support of cores 39. Other configurations of primary chain path 156 and secondary chain path 166 may be employed without departing from inventive concepts disclosed and/or claimed herein. For example, the configuration shown schematically in FIG. 5 (in which primary and secondary distal sprockets are positioned so that the primary and secondary chains with their respective cutting tools are each substantially tangent to a common substantially horizontal plane) may be used to produce relief slots 37 and cores 39 in trench leading edge 36, while leaving no slots in trench bottom 38. In embodiments in which secondary chains 160 cut relief slots, the secondary chains may be operated in a forward direction or in a reverse direction, depending on whether deposition of material within the trench is desired (reverse direction, indicated in FIGS. 4, 5, and 6) or not (forward direction, not shown in FIGS. 4, 5, and 6). If no relief slots are desired, paths 156 and 166 may be configured to substantially coincide at leading edge 36 and bottom 38 of trench 34 (shown schematically in FIG. 6, in which primary and secondary proximal and distal sprockets are positioned so that the primary and secondary chains are substantially tangent to a common plane substantially coinciding with the leading edge of the trench), or paths 156 and 166 may be substantially identical (not shown), thereby producing no relief slots, but still depositing relatively more finely divided disintegrated material on trench bottom 38 when secondary chains 160 are operated in a reverse direction. Various numbers and positions of shafts may be required to accommodate differing paths 156 and 166. For example, the configuration shown schematically in FIG. 4 could be implemented with both proximal primary and secondary sprockets on a common shaft 158/168 but having a larger proximal sprocket for the secondary chain, and both distal primary and secondary sprockets on a common shaft 159/169 but having a larger distal sprocket for the secondary chain. However, the configurations of FIGS. 5 and 6 would require separate shafts 158/168 and 159/169 for primary and secondary proximal and distal sprockets, since the desired cutting geometries could not be readily achieved with concentric primary and secondary sprockets. Without departing from inventive concepts disclosed and/or claimed herein, any number and position of shafts or other structures for rotatably mounting the sprockets on the frame, and any accompanying combinations of sprocket diameters (primary, secondary, proximal, distal) may be used to implement the present invention. In particular, primary chains 150 need not all follow the same path 156, but each primary chain may follow its own path. Similarly, secondary chains 160 need not all follow the same path 166, but each secondary chain may follow its own path 166.

Any suitable drive mechanism may be used to energize a chain, either directly or via a drive sprocket, including as examples, but not limited to: gears, belts, drive chains, transmissions, drive shafts, differential drives, hydraulic motors, combinations thereof, and/or functional equivalents thereof A drive sprocket may be driven directly independently of its respective shaft or other mounting structure, or may be journaled to rotate with its respective shaft, which in turn may be directly driven. Without departing from inventive concepts disclosed and/or claimed herein, any suitable coupling scheme may be employed to connect a drive mechanism to a drive sprockets. Many examples of suitable drive mechanisms and coupling schemes are known in the art, and some of these are disclosed in the patents incorporated by reference hereinabove. While the proximal sprocket may typically serve as the drive sprocket, it may be desirable for the distal sprocket to serve as the drive sprocket for secondary chains driven in the reverse chain direction, so that the portion of the chain in contact with the leading edge of the trench is under tension. Without departing from inventive concepts disclosed and/or claimed herein, a roller or other similar idler structure may be equivalently employed in place of any sprocket that is not driven, and such rollers or other structures shall be construed to fall under the term "sprocket" when used to describe any non-driven sprocket.

Figure 7:
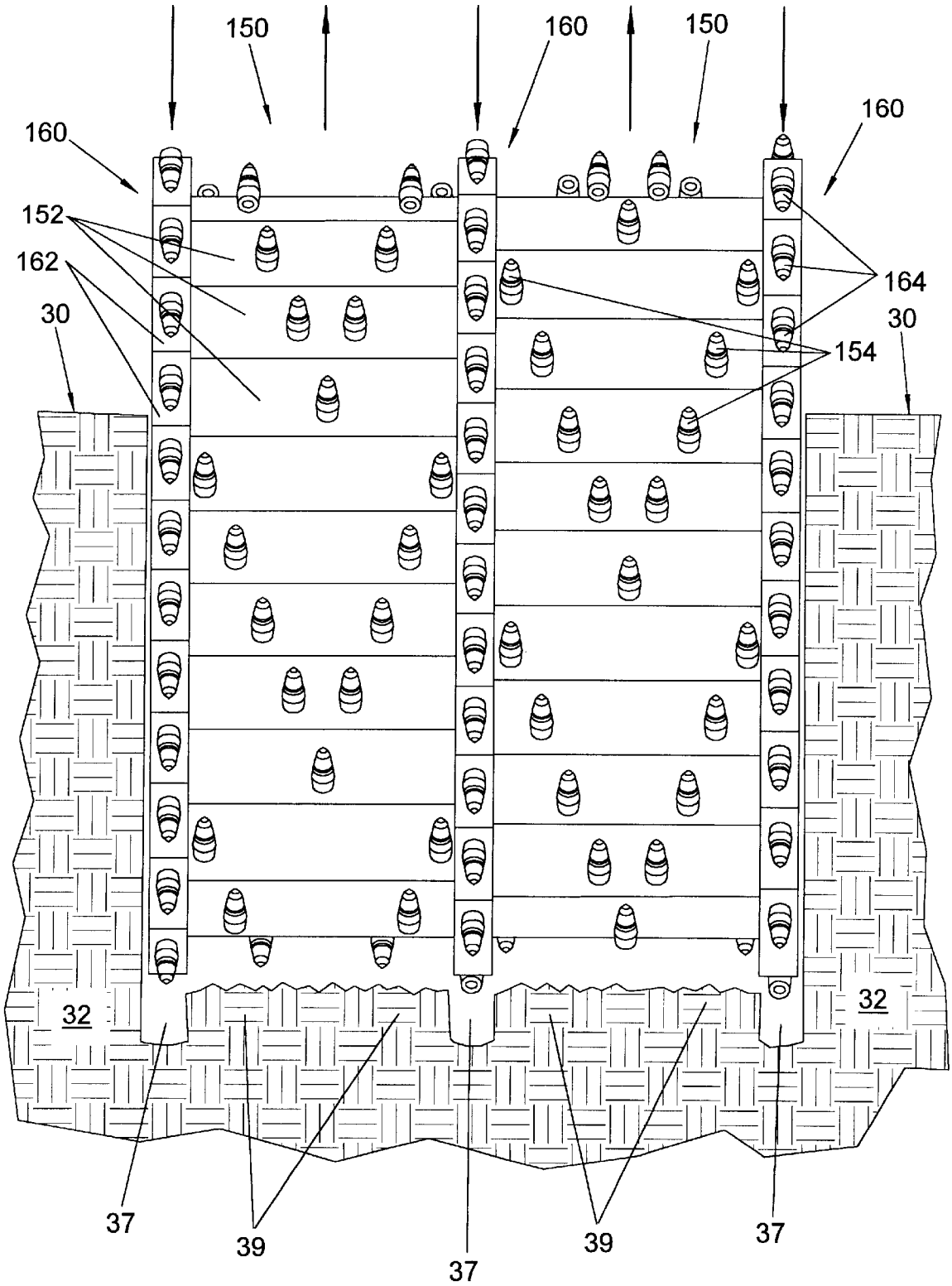
FIG. 7 shows a front view of a trenching head according to the present invention.

Without departing from inventive concepts disclosed and/or claimed herein, various arrangements of earth-cutting tools 154 made be employed on primary chains 150 to take advantage of the presence of relief slots 37 for disintegration and removal of cores 39. In the example shown in FIG. 7, trenching head 100 is viewed from the leading edge 36 of trench 34. Secondary chains 160 are shown being driven in the reverse direction cutting relief slots 37, and producing cores 39. Earth-cutting tools 154 are arranged on primary chain 150 in a staggered "V" pattern, with the outermost tools (the top of the "V") leading the innermost tool (the bottom of the "V") as chain 150 travels upward against the leading edge 36 of the trench. The leading, outermost earth-cutting tools hit core 39 at its edge, where it is weakest and may be most readily disintegrated. Removal of the edge portion of core 39 then weakens the next portion inward from the edge, which is struck and disintegrated by the next earth-cutting tool on chain 150, which is displaced inwardly from the first tool. This pattern of disintegration of outermost remaining portions of core 39 continues from both sides until the center earth-cutting tool (the bottom of the "V") strikes and disintegrates the center (and only remaining) portion of core 39. This cycle is repeated as secondary chains continuously deepen relief slots 37 and cores 39 are disintegrated and removed from their outer edges inward.

A preferred method for digging wide trenches in rock or other hard earth formations using multiple endless-chain digging assemblies according to the present invention comprises the steps of: a) positioning a trenching head assembly 100 (as described hereinabove in its preferred and alternative embodiments) in a ground formation 32 at the desired depth; b) driving primary chains 150 in a forward chain direction; c) driving secondary chains 160 at about one to eight times the linear velocity of primary chains 150; d) moving trenching head assembly 100 in a forward trench digging direction; e) conveying, by the forward motion of primary chains 150, disintegrated material out of trench 34. If the secondary chains are driven in the reverse chain direction, the additional steps may be employed of: f) depositing, by the reverse motion of secondary chains 160, disintegrated material on trench bottom 38; and g) forming the disintegrated material deposited within the trench into a support bed for a structure subsequently placed within the trench.

The present invention has been set forth in the forms of its preferred and alternative embodiments. It is nevertheless intended that modifications to the disclosed multiple-chain trenching apparatus and methods may be made without departing from inventive concepts disclosed and/or claimed herein.

What is claimed is:

1. A method for digging a trench in a hard earth formation, comprising the steps of:

positioning a multiple-chain trenching head assembly in the earth formation at a desired trench depth below a ground surface, the trenching head assembly comprising a frame having a proximal end for operably connecting to a prime mover positioned on the ground surface and thereby enabling positioning of the trenching head within the trench below the ground surface, a pair of primary sprockets, the pair comprising a proximal primary sprocket rotatably mounted on the frame and a distal primary sprocket rotatably mounted on the frame at a distal end thereof, a primary chain engaged with and circulating around the pair of primary sprockets and comprising a plurality of pivotably connected links and a plurality of cutting tools substantially rigidly mounted thereon for disintegrating the earth formation, a pair of secondary sprockets, the pair comprising a proximal secondary sprocket rotatably mounted on the frame and a distal secondary sprocket rotatably mounted on the frame at the distal end thereof, and a secondary chain engaged with and circulating around the pair of secondary sprockets and comprising a plurality of pivotably connected links and a plurality of cutting tools substantially rigidly mounted thereon for disintegrating the earth formation;

driving the primary chain at a primary chain linear drive speed in a forward chain direction, thereby disintegrating material at a leading edge of the trench and conveying disintegrated material upward and out of the trench;

driving the secondary chain at a secondary chain linear drive speed in a reverse chain direction, thereby disintegrating material at the leading edge of the trench and depositing disintegrated material within the trench; and moving the trenching head assembly in a forward trench-digging direction.

2. A method for digging a trench as recited in claim 1, the secondary chain linear drive speed being sufficiently greater than the primary chain linear drive speed so that disintegrated material conveyed downward and deposited within the trench by the secondary chain is more finely divided than disintegrated material conveyed upward and out of the trench by the primary chain.

3. A method for digging a trench as recited in claim 1, further comprising the step of driving the distal secondary sprocket to drive the secondary chain in the reverse direction, thereby maintaining under tension a portion of the secondary chain in contact with the leading edge of the trench.

4. A method for digging a trench as recited in claim 1, the cutting tools mounted on the primary chain being adapted for conveying disintegrated material upward and out of the trench, the cutting tools mounted on the secondary chain being adapted for conveying disintegrated material downward and depositing the disintegrated material within the trench.

5. A method for digging a trench as recited in claim 1, the cutting tools mounted on the secondary chain being smaller than the cutting tools mounted on the primary chain so that disintegrated material conveyed downward and deposited within the trench by the secondary chain is more finely divided than disintegrated material conveyed upward and out of the trench by the primary chain.

6. A method for digging a trench as recited in claim 1, further comprising the step of forming the disintegrated material deposited within the trench into a support bed for a structure subsequently placed within the trench.

7. A trenching head assembly for digging a trench in a hard earth formation, comprising:

a frame having a proximal end for operably connecting to a prime mover positioned on the ground surface and thereby enabling positioning of the trenching head within the trench below the ground surface;

a pair of primary sprockets, the pair comprising a proximal primary sprocket rotatably mounted on the frame and a distal primary sprocket rotatably mounted on the frame at a distal end thereof, a primary chain engaged with and circulating around the pair of primary sprockets and comprising a plurality of pivotably connected links and a plurality of cutting tools substantially rigidly mounted thereon for disintegrating the earth formation;

a pair of secondary sprockets, the pair comprising a proximal secondary sprocket rotatably mounted on the frame and a distal secondary sprocket rotatably mounted on the frame at the distal end thereof; and a secondary chain engaged with and circulating around the pair of secondary sprockets and comprising a plurality of pivotably connected links and a plurality of cutting tools substantially rigidly mounted thereon for disintegrating the earth formation, the primary chain being driven at a primary chain linear drive speed in a forward chain direction, the primary chain being adapted for disintegrating material at a leading edge of the trench and conveying disintegrated material upward and out of the trench, the secondary chain being driven at a secondary chain linear drive speed in a reverse chain direction, the secondary chain being adapted for disintegrating material at the leading edge of the trench and depositing disintegrated material within the trench.

8. A method for digging a trench as recited in claim 7, the secondary chain linear drive speed being sufficiently greater than the primary chain linear drive speed, thereby adapting the trenching head assembly so that disintegrated material conveyed downward and deposited within the trench by the secondary chain is more finely divided than disintegrated material conveyed upward and out of the trench by the primary chain.

9. A trenching head assembly as recited in claim 7, the distal secondary sprocket being driven to drive the secondary chain in the reverse direction, thereby maintaining under tension a portion of the secondary chain in contact with the leading edge of the trench.

10. A trenching head assembly as recited in claim 7, the cutting tools mounted on the primary chain being adapted for conveying disintegrated material upward and out of the trench, the cutting tools mounted on the secondary chain being adapted for conveying disintegrated material downward and depositing the disintegrated material within the trench.

11. A trenching head assembly as recited in claim 7, the cutting tools mounted on the secondary chain being smaller than the cutting tools mounted on the primary chain, thereby adapting the trenching head assembly so that disintegrated material conveyed downward and deposited within the trench by the secondary chain is more finely divided than disintegrated material conveyed upward and out of the trench by the primary chain.

12. A method for digging a trench in a hard earth formation, comprising the steps of:

positioning a multiple-chain trenching head assembly in the earth formation at a desired trench depth below a ground surface, the trenching head assembly comprising a frame having a proximal end for operably connecting to a prime mover positioned on the ground surface and thereby enabling positioning of the trenching head within the trench below the ground surface, a pair of primary sprockets, the pair comprising a proximal primary sprocket rotatably mounted on the frame and a distal primary sprocket rotatably mounted on the frame at a distal end thereof, a primary chain engaged with and circulating around the pair of primary sprockets and comprising a plurality of pivotably connected links and a plurality of cutting tools substantially rigidly mounted thereon for disintegrating the earth formation, a pair of secondary sprockets, the pair comprising a proximal secondary sprocket rotatably mounted on the frame and a distal secondary sprocket rotatably mounted on the frame at the distal end thereof, and a secondary chain engaged with and circulating around the pair of secondary sprockets and comprising a plurality of pivotably connected links and a plurality of cutting tools substantially rigidly mounted thereon for disintegrating the earth formation;

driving the primary chain at a primary chain linear drive speed in a forward chain direction, thereby disintegrating material at a leading edge of the trench and conveying disintegrated material upward and out of the trench;

driving the secondary chain at a secondary chain linear drive speed, thereby disintegrating material from the leading edge of the trench; and moving the trenching head assembly in a forward trench-digging direction, the proximal secondary sprocket being substantially larger than and mounted substantially coaxially with respect to the proximal primary sprocket and the distal secondary sprocket being substantially larger than and mounted substantially coaxially with respect to the distal primary sprocket, so that disintegration of material by the secondary chain produces a relief cut in the leading edge of the trench and a bottom surface of the trench.

13. A trenching head assembly for digging a trench in a hard earth formation, comprising:

a frame having a proximal end for operably connecting to a prime mover positioned on the ground surface and thereby enabling positioning of the trenching head within the trench below the ground surface;

a pair of primary sprockets, the pair comprising a proximal primary sprocket rotatably mounted on the frame and a distal primary sprocket rotatably mounted on the frame at a distal end thereof;

a primary chain engaged with and circulating around the pair of primary sprockets and comprising a plurality of pivotably connected links and a plurality of cutting tools substantially rigidly mounted thereon for disintegrating the earth formation;

a pair of secondary sprockets, the pair comprising a proximal secondary sprocket rotatably mounted on the frame and a distal secondary sprocket rotatably mounted on the frame at the distal end thereof; and a secondary chain engaged with and circulating around the pair of secondary sprockets and comprising a plurality of pivotably connected links and a plurality of cutting tools substantially rigidly mounted thereon for disintegrating the earth formation, the primary chain being driven at a primary chain linear drive speed in a forward chain direction, the primary chain being adapted for disintegrating material at a leading edge of the trench and conveying disintegrated material upward and out of the trench, the secondary chain being driven at a secondary chain linear drive speed, the secondary chain being adapted for disintegrating material at the leading edge of the trench, the proximal secondary sprocket being substantially larger than and mounted substantially coaxially with respect to the proximal primary sprocket, the distal secondary sprocket being substantially larger than and mounted substantially coaxially with respect to the distal primary sprocket, thereby adapting the trenching head assembly so that disintegration of material by the secondary chain produces a relief cut in the leading edge of the trench and a bottom surface of the trench.

* * * * *